US008783530B1

(12) United States Patent
Jordan

(10) Patent No.: US 8,783,530 B1
(45) Date of Patent: Jul. 22, 2014

(54) INFANT CARRIER AND IMPLEMENT STORAGE ASSEMBLY

(76) Inventor: Hazel A. Jordan, Kansas City, MO (US)

( * ) Notice: Subject to any disclaimer, the term of this patent is extended or adjusted under 35 U.S.C. 154(b) by 141 days.

(21) Appl. No.: 13/405,265

(22) Filed: Feb. 25, 2012

(51) Int. Cl.
*A47D 13/02* (2006.01)

(52) U.S. Cl.
USPC ..... 224/159; 224/158; 224/160

(58) Field of Classification Search
USPC ..... 224/159, 158, 160
See application file for complete search history.

(56) References Cited

U.S. PATENT DOCUMENTS

| | | | | | |
|---|---|---|---|---|---|
| 1,605,473 | A | * | 11/1926 | Schneidau | 297/275 |
| 2,496,216 | A | * | 1/1950 | Kaminski | 224/159 |
| 2,537,864 | A | * | 1/1951 | Skaer | 224/159 |
| 2,550,851 | A | * | 5/1951 | Nichols | 224/577 |
| 2,690,864 | A | * | 10/1954 | Dautermann et al. | 224/159 |
| 3,327,914 | A | * | 6/1967 | Abram | 224/159 |
| 3,575,326 | A | * | 4/1971 | Chappell | 224/159 |
| 3,780,919 | A | * | 12/1973 | Hansson | 224/160 |
| 4,428,514 | A | * | 1/1984 | Elf | 224/579 |
| 4,467,945 | A | * | 8/1984 | Schaapveld | 224/160 |
| 4,469,259 | A | * | 9/1984 | Krich et al. | 224/160 |
| 4,492,326 | A | * | 1/1985 | Storm | 224/160 |
| 4,903,873 | A | * | 2/1990 | Poole et al. | 224/160 |
| D322,695 | S | * | 12/1991 | LaDue | D30/144 |
| D323,426 | S | | 1/1992 | Mahvi et al. | |
| 5,246,152 | A | * | 9/1993 | Dotseth | 224/159 |
| 5,361,952 | A | * | 11/1994 | Gold | 224/159 |
| 5,492,256 | A | | 2/1996 | Ive | |
| 5,570,823 | A | * | 11/1996 | Lindy | 224/160 |
| D377,116 | S | * | 1/1997 | Shimura et al. | D3/214 |
| D406,945 | S | * | 3/1999 | Callihan | D3/303 |
| 5,950,887 | A | * | 9/1999 | Powell | 224/158 |
| 6,325,259 | B1 | | 12/2001 | Tharalson et al. | |
| 7,389,897 | B2 | * | 6/2008 | Pistiolis et al. | 224/577 |
| 7,574,750 | B2 | * | 8/2009 | Harris | 2/80 |
| 8,172,116 | B1 | * | 5/2012 | Lehan et al. | 224/160 |
| 2002/0050503 | A1 | * | 5/2002 | Spero | 224/655 |
| 2005/0045674 | A1 | * | 3/2005 | Rehbein | 224/160 |
| 2006/0130220 | A1 | * | 6/2006 | Morgan et al. | 2/456 |
| 2007/0122066 | A1 | | 5/2007 | Landay | |
| 2007/0228091 | A1 | | 10/2007 | Shawen | |
| 2009/0026234 | A1 | | 1/2009 | Chuang | |
| 2009/0108036 | A1 | * | 4/2009 | Moore et al. | 224/153 |
| 2010/0096419 | A1 | * | 4/2010 | Stephens | 224/153 |
| 2011/0062202 | A1 | * | 3/2011 | Sand | 224/577 |

* cited by examiner

*Primary Examiner* — Justin Larson
*Assistant Examiner* — Lester L Vanterpool

(57) ABSTRACT

An infant carrier and implement storage assembly provides for comfortable and safe carrying of an infant and necessary implements needed for caring for the infant. The assembly includes a pocket having a front panel, a rear panel, a closed bottom end, an open top, a first side, and a second side. The first side and second side each extend between the bottom end and the open top. A pair of leg apertures extends through the front panel proximate the bottom end of the pocket to receive legs of an infant positioned in the pocket. A first strap is coupled to the rear panel of the pocket for coupling the pocket to a person. A first side closure and second side closure are each coupled to and extend along opposite side of the pocket to allow use of the pocket in an open position as a changing pad.

12 Claims, 6 Drawing Sheets

INFANT CARRIER AND IMPLEMENT STORAGE ASSEMBLY

BACKGROUND OF THE DISCLOSURE

Field of the Disclosure

The disclosure relates to infant carrying devices and more particularly pertains to a new infant carrying device for comfortably and safely carrying an infant and necessary implements needed for caring for the infant.

SUMMARY OF THE DISCLOSURE

An embodiment of the disclosure meets the needs presented above by generally comprising a pocket having a front panel, a rear panel, a closed bottom end, an open top, a first side, and a second side. The first side and second side each extend between the bottom end and the open top. A pair of leg apertures extends through the front panel proximate the bottom end of the pocket to receive legs of an infant positioned in the pocket. A first strap is coupled to the rear panel of the pocket for coupling the pocket to a person. A first side closure and second side closure are each coupled to and extend along opposite side of the pocket to allow use of the pocket in an open position as a changing pad.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
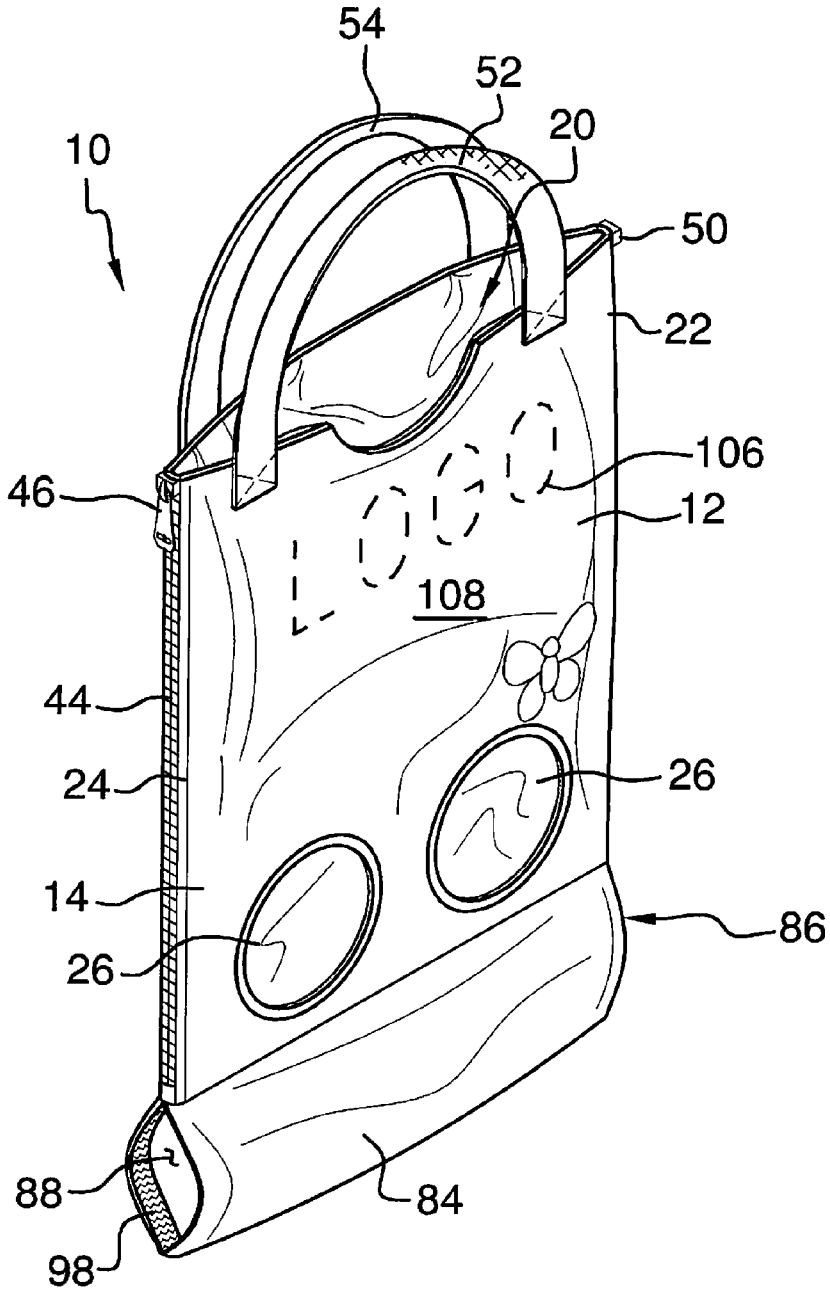
FIG. 1 is a top front side perspective view of a infant carrier and implement storage assembly according to an embodiment of the disclosure.
Figure 2:
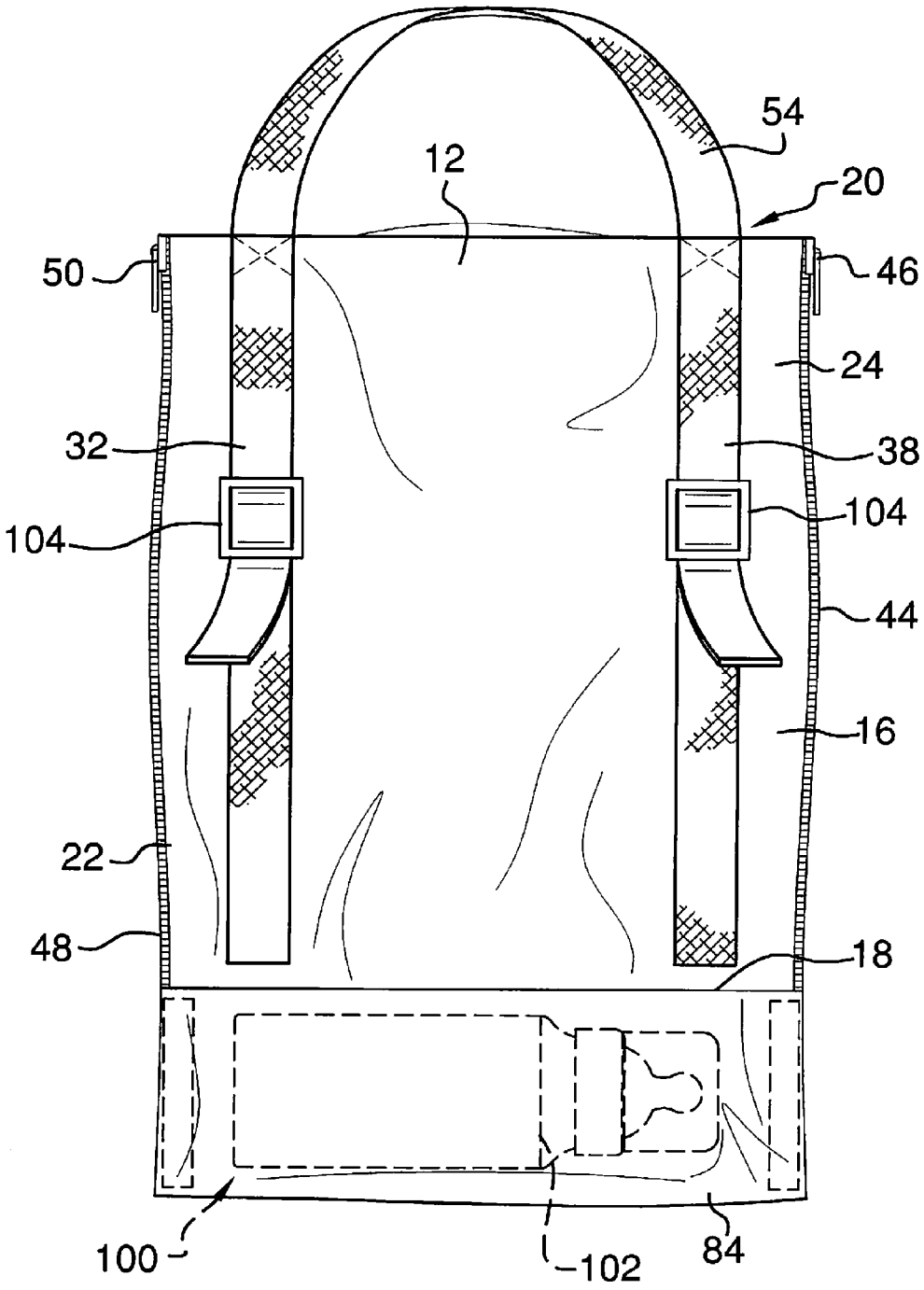
FIG. 2 is a back view of an embodiment of the disclosure.

With reference now to the drawings, and in particular to FIGS. 1 through 6 thereof, a new infant carrying device embodying the principles and concepts of an embodiment of the disclosure and generally designated by the reference numeral 10 will be described.

As best illustrated in FIGS. 1 through 6, the infant carrier and implement storage assembly 10 generally comprises a pocket 12 having a front panel 14, a rear panel 16, a closed bottom end 18, an open top 20, a first side 22, and a second side 24. The first side 22 extends between the bottom end 18 and the open top 20. The second side 24 also extends between the bottom end 18 and the open top 20. A pair of leg apertures 26 extends through the front panel 14. The leg apertures 26 are positioned proximate the bottom end 18 of the pocket 12. Thus, the leg apertures 26 are configured for receiving legs 28 of an infant 30 positioned in the pocket 12. A first strap 32 is coupled to the rear panel 16 of the pocket 12 on an outer surface 34 of the rear panel 16 whereby the pocket 12 is configured for being coupled to a person 36. A second strap 38 is also coupled to the rear panel 16 of the pocket 12. The second strap 38 may be positioned in parallel spaced relationship to the first strap 32. Thus, the first strap 32 and the second strap 38 are configured for looping over shoulders 40 of the person 36 to wear the pocket 12 like a backpack or in reverse positioning the infant 30 against a chest 42 of the person 36. The first strap 32 and second strap 38 may each have a respective buckle 104 making them adjustable in length to facilitate comfortable wearing of the pocket 12 by the person 36.

A first side closure 44 is coupled to and extends along the first side 22 of the pocket 12. The first side closure 44 may be a zipper 46. The first side closure 44 selectively couples the front panel 14 to the rear panel 16. Similarly, a second side closure 48 is coupled to and extends along the second side 22 of the pocket 12. The second side closure 48 may also be a zipper 50. The second side closure 48 selectively couples the front panel 14 to the rear panel 16. The front panel 14 and the rear panel 16 may be constructed of a padded or quilted material. When the first side closure 44 and the second side closure 48 are opened, the front panel 14 may be peeled back from the rear panel 16 and laid on a surface for use as a changing pad for the infant 30.

A front handle 52 may be coupled to the front panel 14 of the pocket 12. A rear handle 54 may also be coupled to the rear panel 16 of the pocket 12. The rear handle 54 may extend integrally from the first strap 32 and the second strap 38.

A front pouch 56 is coupled to an inner surface 58 of the front panel 14 and a rear pouch 60 is coupled to an inner surface 62 of the rear panel 16. The front pouch 56 is configured for holding diapers 64 and the rear pouch 60 is configured to hold pre-moistened wipes 66 needed to change a diaper.

For warmth and protection a hood 68 has a lower edge 70 coupled to the rear panel 16 of the pocket 12 proximate the open top 20. The hood 68 is positioned for covering a head 72 of the infant 30 when the infant is positioned in the pocket 12. An inflatable pillow 74 may also be coupled to the front panel 14 of the pocket 12. A valve 76 may be coupled to the pillow 74 for selectively inflating and deflating the pillow 74 to a desired pressure. Alternatively, the pillow 74 may be filled with a conventional resiliently compressible material.

A belt 78 is coupled to the inner surface 62 of the rear panel 16 of the pocket 12. The belt 78 may have a pair of sections selectively joined by a clasp 82 such that the belt 78 is configured for positioning around the infant 30 positioned in the pocket 12. The belt 78 extends between vertically orientated back braces 80 comprised of a non-bendable or a bending resistive material.

Figure 3:
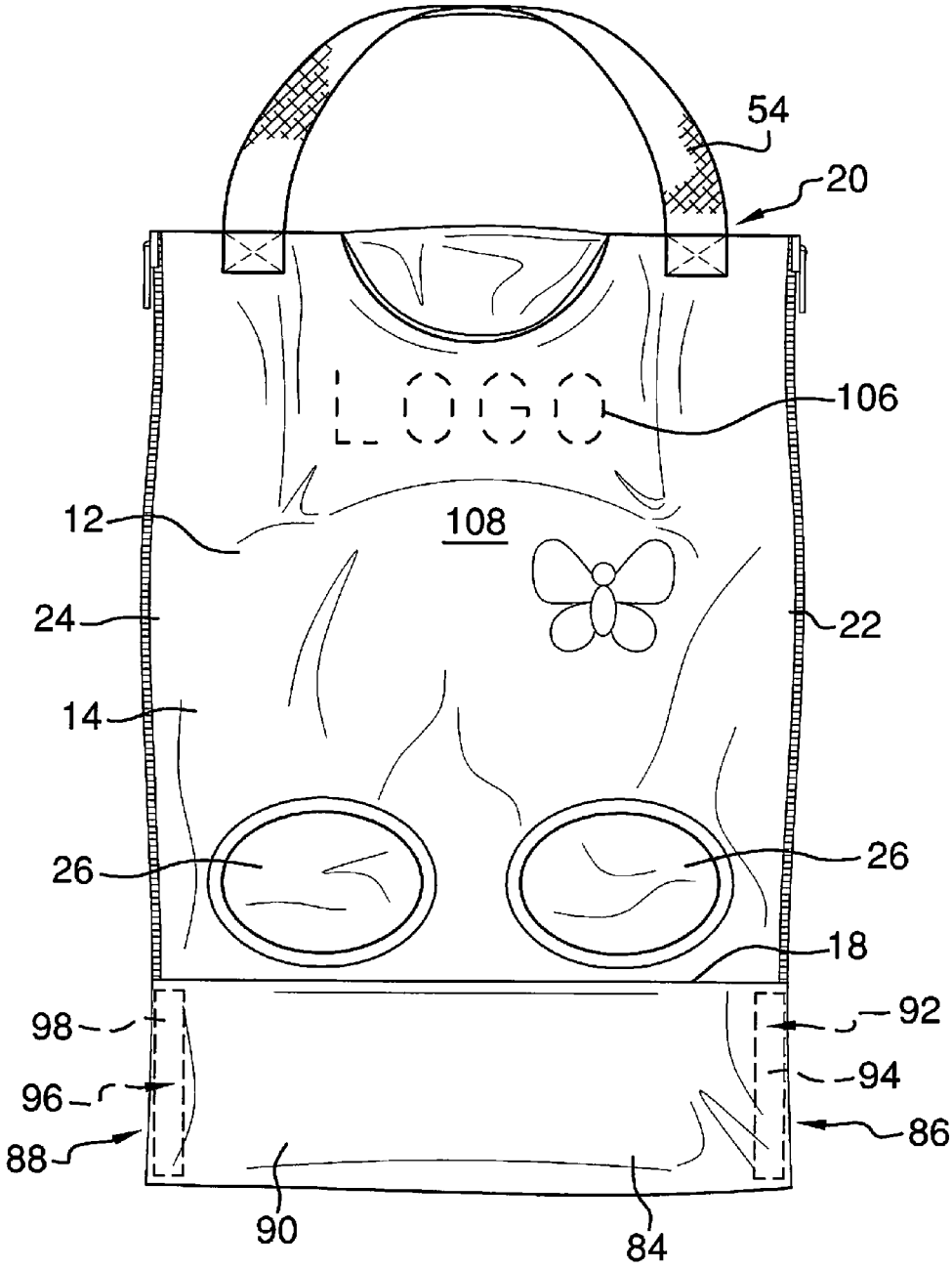
FIG. 3 is a front view of an embodiment of the disclosure.
Figure 4:
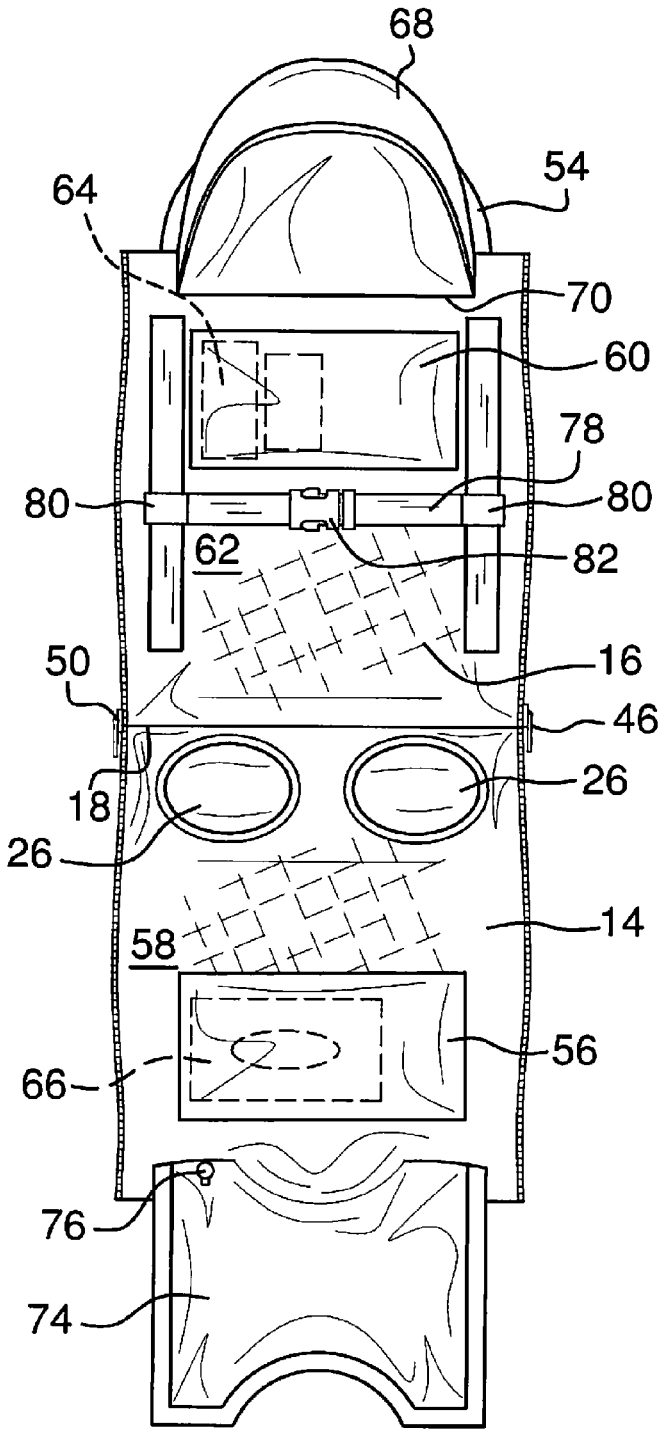
FIG. 4 is a top view of an embodiment of the disclosure in an open position.
Figure 5:
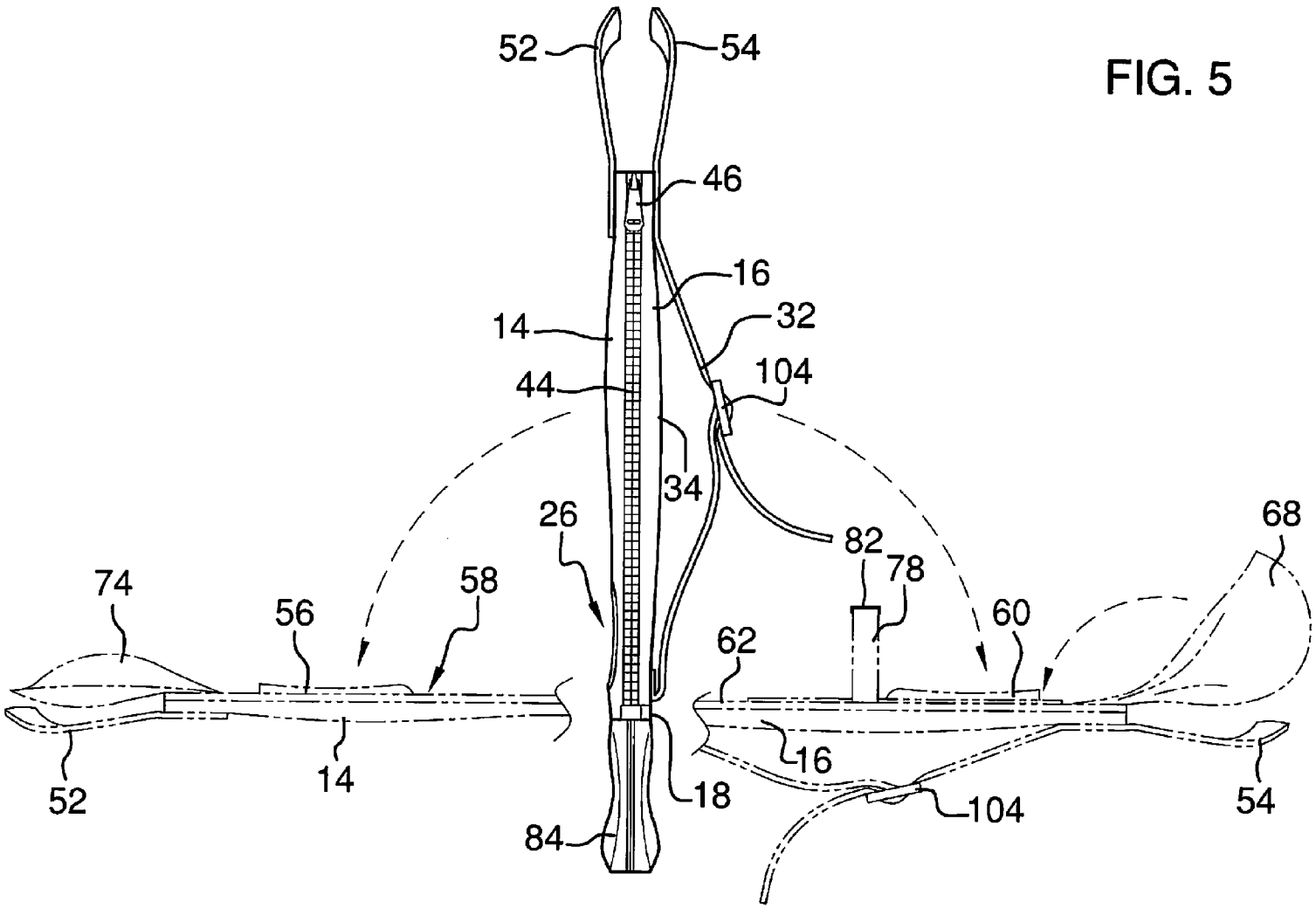
FIG. 5 is a side view of an embodiment of the disclosure.
Figure 6:
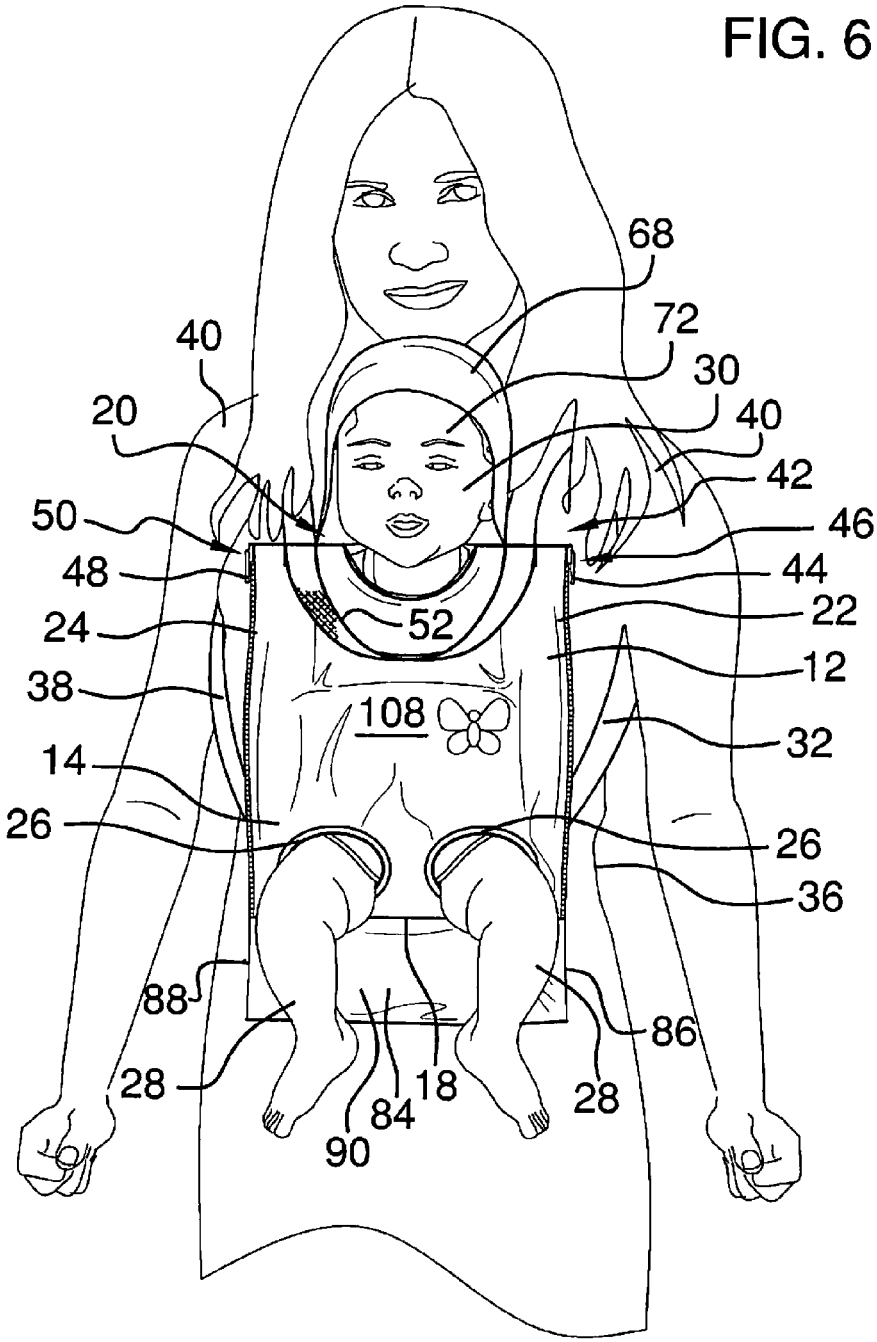
FIG. 6 is a front view of an embodiment of the disclosure in use.

An elongated tube 84 has an open first end 86, an open second end 88, and a perimeter wall 90 extending between the open first end 86 and the open second end 88. The perimeter wall 90 is coupled to the bottom end 18 of the pocket 12. A first end closure 92, which may be constructed of complimentary portions of hook and loop fastener 94, is coupled to the first end 86 of the tube 84. Similarly, a second end closure 96 may be coupled to the second end 88 of the tube 84. The second end closure 96 may also be complimentary portions of hook and loop fastener 98. The tube 84 is sized to provide additional storage space and hold items 100 such as but not limited to powder, cream, or a feeding bottle 102 as shown in FIG. 3. A logo or other indicia 106 may also be positioned on an outer surface 108 of the pocket 12 for decoration.

In use, the pocket 12 is worn by the person 36 to carry the infant 30. The assembly 10 provides additional storage for items such as diapers and the feeding bottle 102

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. An infant carrying assembly comprising:

a pocket having a front panel, a rear panel, closed bottom end, an open top, a first side, and a second side, said first side extending between said bottom end and said open top, said second side extending between said bottom end and said open top;

a pair of leg apertures extending through said front panel, said leg apertures being positioned proximate said bottom end of said pocket whereby said leg apertures are configured for receiving legs of an infant positioned in said pocket;

a first strap coupled to said rear panel of said pocket whereby said pocket is configured for being coupled to a person;

a first side closure coupled to and extending along said first side of said pocket, said first side closure selectively coupling said front panel to said rear panel;

a second side closure coupled to and extending along said second side of said pocket, said second side closure selectively coupling said front panel to said rear panel;

an elongated tube having an open first end, an open second end, and a perimeter wall extending between said open first end and said open second end wherein said tube is configured for storing items enclosed within said tube, said perimeter wall being coupled to said bottom edge of said pocket;

a first end closure coupled to said tube; and a second end closure coupled to said tube.

2. The assembly of claim 1, further including a front handle coupled to said front panel of said pocket.

3. The assembly of claim 2, further including a rear handle coupled to said rear panel of said pocket.

4. The assembly of claim 1, further including a second strap coupled to said rear panel of said pocket, said second strap being positioned in spaced relationship to said first strap whereby said first strap and said second strap are configured for looping over shoulders of the person.

5. The assembly of claim 1, further including a front pouch coupled to an inner surface of said front panel.

6. The assembly of claim 1, further including a rear pouch coupled to an inner surface of said rear panel.

7. The assembly of claim 1, further including a hood having a lower edge coupled to said rear panel of said pocket proximate said open top whereby said hood is configured for covering a head of the infant when the infant is positioned in the pocket.

8. The assembly of claim 1, further including a pillow coupled to said front panel of said pocket.

9. The assembly of claim 8, further including said pillow being inflatable.

10. The assembly of claim 9, further including a valve coupled to said pillow for selectively inflating and deflating said pillow.

11. The assembly of claim 1, further including a belt coupled to an inner surface of said rear panel of said pocket, said belt being configured for positioning around an infant positioned in said pocket.

12. An infant carrying assembly comprising:

a pocket having a front panel, a rear panel, closed bottom end, an open top, a first side, and a second side, said first side extending between said bottom end and said open top, said second side extending between said bottom end and said open top;

a pair of leg apertures extending through said front panel, said leg apertures being positioned proximate said bottom end of said pocket whereby said leg apertures are configured for receiving legs of an infant positioned in said pocket;

a first strap coupled to said rear panel of said pocket whereby said pocket is configured for being coupled to a person;

a second strap coupled to said rear panel of said pocket, said second strap being positioned in spaced relationship to said first strap whereby said first strap and said second strap are configured for looping over shoulders of the person;

a first side closure coupled to and extending along said first side of said pocket, said first side closure selectively coupling said front panel to said rear panel;

a second side closure coupled to and extending along said second side of said pocket, said second side closure selectively coupling said front panel to said rear panel;

a front handle coupled to said front panel of said pocket;

a rear handle coupled to said rear panel of said pocket;

an elongated tube having an open first end, an open second end, and a perimeter wall extending between said open first end and said open second end wherein said tube is configured for storing items enclosed within said tube, said perimeter wall being coupled to said bottom edge of said pocket;

a first end closure coupled to said first end of said tube;

a second end closure coupled to said second end of said tube;

a front pouch coupled to an inner surface of said front panel;

a rear pouch coupled to an inner surface of said rear panel;

a hood having a lower edge coupled to said rear panel of said pocket proximate said open top whereby said hood is configured for covering a head of the infant when the infant is positioned in the pocket;

a pillow coupled to said front panel of said pocket, said pillow being inflatable;

a valve coupled to said pillow for selectively inflating and deflating said pillow; and a belt coupled to an inner surface of said rear panel of said pocket, said belt being configured for positioning around an infant positioned in said pocket.

* * * * *